US006415864B1

(12) United States Patent
Ramakrishnan et al.

(10) Patent No.: US 6,415,864 B1
(45) Date of Patent: Jul. 9, 2002

(54) SYSTEM AND METHOD FOR SEPARATELY PRODUCING WATER AND OIL FROM A RESERVOIR

(75) Inventors: Terizhandur S. Ramakrishnan, Bethel; Brindesh Dhruva, Danbury; Raj Kumar Michael Thambynayagam, Ridgefield; Min-Yi Chen, West Redding, all of CT (US); Peter A. Goode, Houston; Rod F. Nelson, Sugar Land, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 65 days.

(21) Appl. No.: 09/726,294

(22) Filed: Nov. 30, 2000

(51) Int. Cl.[7] ..... E21B 47/04

(52) U.S. Cl. ..... 166/250.03; 166/250.15; 166/250.17; 166/306; 166/369; 166/54.1; 166/66

(58) Field of Search ..... 166/250.01, 254.1, 166/250.03, 250.15, 250.17, 305.1, 306, 369, 53, 54.1, 65.1, 66

(56) References Cited

U.S. PATENT DOCUMENTS

| | | | |
|---|---|---|---|
| 3,195,633 A | | 7/1965 | Jacob |
| 3,199,592 A | | 8/1965 | Jacob |
| 3,638,731 A | | 2/1972 | Driscoll |
| 3,838,335 A | | 9/1974 | Miller |
| 4,142,411 A | * | 3/1979 | Deal |
| 4,766,957 A | | 8/1988 | McIntyre |
| 5,038,108 A | | 8/1991 | Lessi et al. |
| 5,335,542 A | | 8/1994 | Ramakrishnan et al. |
| 5,366,011 A | | 11/1994 | Jennings, Jr. |
| 5,481,502 A | | 1/1996 | Cretin et al. |
| 5,642,051 A | | 6/1997 | Babour et al. |
| 5,767,680 A | | 6/1998 | Torres-Verdin et al. |
| 5,810,080 A | | 9/1998 | Meynier |
| 5,813,469 A | | 9/1998 | Bowlin |
| 5,842,520 A | | 12/1998 | Bolin |
| 5,864,099 A | | 1/1999 | Wittrisch et al. |
| 5,992,519 A | | 11/1999 | Ramakrishnan et al. |
| 6,076,599 A | | 6/2000 | McKinzie |
| 6,092,599 A | | 7/2000 | Berry et al. |
| 6,092,600 A | | 7/2000 | McKinzie et al. |

FOREIGN PATENT DOCUMENTS

| | | |
|---|---|---|
| WO | WO 98/36155 | 8/1998 |
| WO | WO 99/15755 | 4/1999 |
| WO | WO 00/14381 | 3/2000 |

OTHER PUBLICATIONS

Gunning, J., Paterson, L., Poliak, B. Coning in dual completed systems, J. Pet. Sci. Engng., 23:27–39, 1999.
Muskat, M. Physical principles of oil production. McGraw–Hill, New York, 1949.

(List continued on next page.)

*Primary Examiner*—Roger Schoeppel
(74) *Attorney, Agent, or Firm*—Fletcher, Yoder & Van Someren

(57) ABSTRACT

A system for reservoir control. The system allows segregated production of fluids, e.g. water and oil, to control the fluid-fluid interface. Downhole sensors are utilized in providing data about the location of the interface. This permits the proactive monitoring and control of the interface prior to unwanted intermingling of fluids, e.g. oil and water, during production.

34 Claims, 8 Drawing Sheets

OTHER PUBLICATIONS

Ramakrishnan, T.S. and Wilkinson, D. Water–cut and fractional–flow logs from array induction measurements. SPE Reservior Eval., 2(1):85–94, 1999.

Swisher, M.D. and Wojtanowicz, A.K. In situ–segregated production of oil and water—A production method with environmental merit: Field application, Soc. Pet. Eng., 43–50, 1995.

Waxman, M.H. and Smits, L.J.M. Electrical conductivities in oil–bearing shaly sands. Soc. Pet. Eng. J., 8:107–122, 1968.

Wojtanowicz, Andrew K.; Downhole Water Sink (DWS) Technology Initiative; 14 pages.

Shirman, Ephim I.; A Well Completion Design Model for Water–Free Production from Reservoirs Overlaying Aquifers; SPE International Student Paper Contest; Oct. 6–9, 1996; 8 pages; Society of Petroleum Engineers; Richardson, TX, U.S.A.

Swisher, M.D. & Wojtanowicz, A.K.; New Dual Completion Method Eliminates Bottom Water Coning; SPE 30697; Oct. 22–25, 1995; 7 pages; Society of Petroleum Engineers; Richardson, TX, U.S.A.

Wojtanowicz, Andrew K., Hui Xu, & Bassiouni, Zaki; Segregated Production Method for Oil Wells With Active Water Coning; Journal of Petroleum Science and Engineering; 1994; 15 pages; vol. 11.

Meritorious Engineering Award Winners; Petroleum Engineer International; Jun. 1996; 2 pages; Houston, TX, U.S.A.

* cited by examiner-

SYSTEM AND METHOD FOR SEPARATELY PRODUCING WATER AND OIL FROM A RESERVOIR

FIELD OF THE INVENTION

The present invention relates generally to the production of oil and water from a reservoir to limit the watercut or water coning effects, and particularly to a system that utilizes an array of sensors for sensing the oil and water interface to permit better control over the movement of that interface.

BACKGROUND OF THE INVENTION

In some oil reservoirs, the oil production rate has been limited by the inability to produce oil devoid of water. In vertical wells, the upper limit of oil production rates has been limited by watercutting, sometimes referred to as water coning, where water is drawn into the oil zone perforations.

Water coning is caused by a hydraulic potential difference between the fluid in the perforations and in the aquifer. Basically, the radial pressure drop due to oil flow causes water to rise towards the oil perforations. The rise of water to the oil perforations may be limited by reducing the rate of oil production but this, of course, greatly limits the "clean" oil production rate.

Attempts have been made to produce both oil and water from appropriately located oil perforations and water perforations to prevent the draw of water into the oil perforations. The water perforations are formed through the wellbore casing, and water is removed from the aquifer through the perforations at a rate that is estimated to reduce water coning. One problem in existent systems is the difficulty of controlling the production rates of oil and water to ensure that neither water coning nor oil coning into the water perforation occurs. Because there is no dependable way to determine the advent of water coning or oil coning, the production rates of oil and/or water are adjusted only when water is found in the produced oil or oil in the produced water. Once this occurs, however, the produced oil or water is no longer clean, and sometimes the coning effect is difficult to reverse.

SUMMARY OF THE INVENTION

According to the present technique, a sensor array is utilized at a downhole location across the oil-water interface. The sensors are designed to output signals from which the presence of oil or water may be determined. The outputs generated are used, for instance, either directly or in a model based on reservoir characteristics. The sensors permit detection of movement in the oil-water interface which, in turn, allows the production rate of oil and/or water to be changed in a manner that will compensate for the movement in the oil-water interface. Thus, the effects of water coning or oil coning can be detected and limited or reversed at an early stage of development.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

In the following description, dual completions are used to produce two liquids from a subterranean location. The differing types of liquid are detected and the production rate of each liquid is selected to control the interface formed between the liquids. In a typical application, the system is utilized to enhance the production of "clean" oil when an oil-water interface is formed between oil at a high subterranean zone and water at a contiguous, lower subterranean zone. Although the following discussion focuses on the production of oil and the oil-water interface commonly found in certain reservoirs, the system is not limited to use with those specific liquids.

A variety of dual completions designs may be used for the production of oil and water, as known to those of ordinary skill in the art now and in the future. However, a few general applications are described herein to enhance an understanding of the system and method for controlling the production of oil and water in a way that limits the formation of water coning or oil coning.

Figure 1:
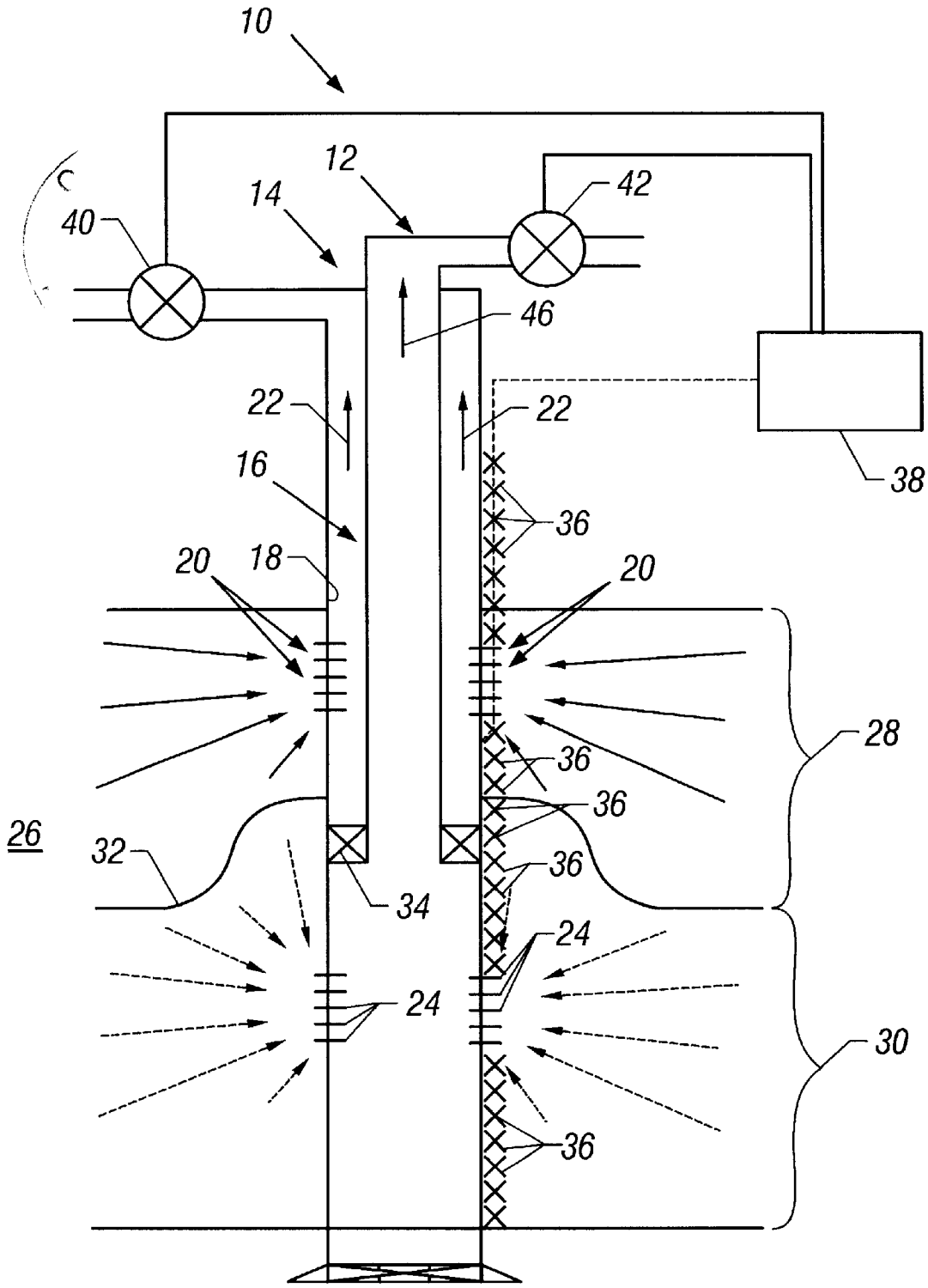
FIG. 1 is a front elevational view of an exemplary dual completion used for the production of oil and water.

Referring generally to FIG. 1, a production system 10 for the controlled production of oil and water is illustrated. System 10 includes a dual completion having a water production completion 12 and an oil production completion 14. The dual completion is deployed in a wellbore 16 typically lined by a wellbore casing 18.

Wellbore casing 18 includes a plurality of openings through which production fluids flow into wellbore 16. For example, the plurality of openings may include a set of oil perforations 20 through which oil flows into wellbore 16 for production along a fluid flow path 22. Similarly, wellbore casing 18 includes a plurality of water perforations 24 through which water flows into wellbore 16.

In the illustrated embodiment, wellbore 16 is formed in a geological formation 26 having an oil zone 28 disposed generally above a water zone 30. Oil perforations 20 are located within oil zone 28 to permit the inflow of oil into wellbore 16, and water perforations 24 are disposed within water zone 30 to permit the inflow of water into wellbore 16. An oil-water interface 32 forms the boundary between the oil zone 28 and the water zone 30 and is preferably maintained between oil perforations 20 and water perforations 24. As described above, in the event removal of oil from oil zone 28 is at too great a rate relative to the production of water from water zone 30, water coning can occur in which water cuts into the production of oil and enters oil perforations 20. Contrariwise, if the relative production rate of water from water zone 30 is too great, oil coning can occur where the oil-water interface 32 is drawn towards water perforations 24 until oil is drawn through perforations 24.

Within wellbore 16, the inflow of oil from oil zone 28 is separated from the inflow of water through water perforations 24 by a separation device, such as a packer 34. Packer 34 is deployed to permit the separate production of water through water completion 12 and oil through oil completion 14. Effectively, packer 34 divides the wellbore 16 into a lower water zone and an upper oil zone by preventing mixing of oil and water after the liquids enter wellbore 16.

Changes in the position of the oil-water interface 32 are detected by a plurality of sensors 36 disposed along wellbore 16 and across oil-water interface 32. Individual sensors of the array of sensors 36 are designed to detect the presence of a given liquid. A signal is output from each sensor to indicate the presence of, for example, either oil or water. Thus, movement of the oil-water interface 32 can be detected as it moves vertically from one sensor to the next along wellbore 16.

One exemplary plurality of sensors 36 includes an array of electrodes. The array of electrodes permits real-time sensing and controlling of the production rates of oil and/or water. Due to the conductivity contrast between oil and water, the electrodes provide direct information regarding the movement of the oil-water interface. For example, the electrodes can be used as passive voltage measuring sensors able to output a signal indicative of the presence of oil or water. In an exemplary embodiment, one or more of the electrodes are used for current transmission while the remaining electrodes are used as passive voltage measuring sensors. In the embodiment illustrated, the electrodes extend along the exterior of wellbore casing 18 above, between and below the oil perforations and the water perforations.

The signals output by sensors 36 are transferred to a receiving station 38 that preferably also functions as a controller for controlling the flow rates of liquid through one or both of the water completion 12 and the oil completion 14. Specific use of the data received from sensor array 36 may vary depending on the specific environment and application. For example, the data of voltages/currents, pressures and flow rates may be used in conjunction with a reservoir model. In this application, a reservoir model is constructed to compute values for various production and formation parameters, e.g. given the flow rates and reservoir parameters, saturation levels, conductivities, pressures and the electrode potentials may be computed. The computed values are compared to the observed data, and the reservoir model is iteratively updated. The fluid production rates are adjusted according to new optimization calculations for the model.

In another exemplary application, the data output from sensors 36 is used directly rather than in conjunction with a reservoir model. In this approach, an estimate for the desired electrode sensor values or interface locations is made and a control algorithm is determined to adjust the flow rate(s) of the oil and/or water in a manner that maintains the electrode sensor values or the estimated oil-water interface at a desired level. This approach allows direct observation of the formation rather than carrying out reservoir model updates. This latter approach may be called observation-based control.

Regardless of whether the sensor data is used directly or in conjunction with a reservoir model, the receiving station/controller 38 utilizes the data output by sensors 36 to adjust one or both of the flow rates of water and oil. For example, in one type of production application, controller 38 is coupled to an oil control valve 40 and a water control valve 42, shown schematically in FIG. 1. Control valves 40 and 42 can be adjusted to permit increased or decreased flow of oil and/or water.

Receiving/control station 38 can be constructed according to a variety of designs. The station could be constructed to present information from sensors 36 to an operator who would then, based on this information, adjust the oil and/or water flow rates. Alternatively, receiving station 38 can utilize a computer programmed to appropriately analyze the data received from sensors 36 and automatically adjust one or both of the oil and water flow rates, as would be understood by one of ordinary skill in the art.

Also, a variety of sensors 36 can be used to detect the oil-water interface 32. However, when sensors, such as electrodes are utilized, the sensors preferably are deployed along wellbore 16 external to wellbore casing 18. This permits direct contact of sensors 36 with the surrounding oil or water.

Figure 2:
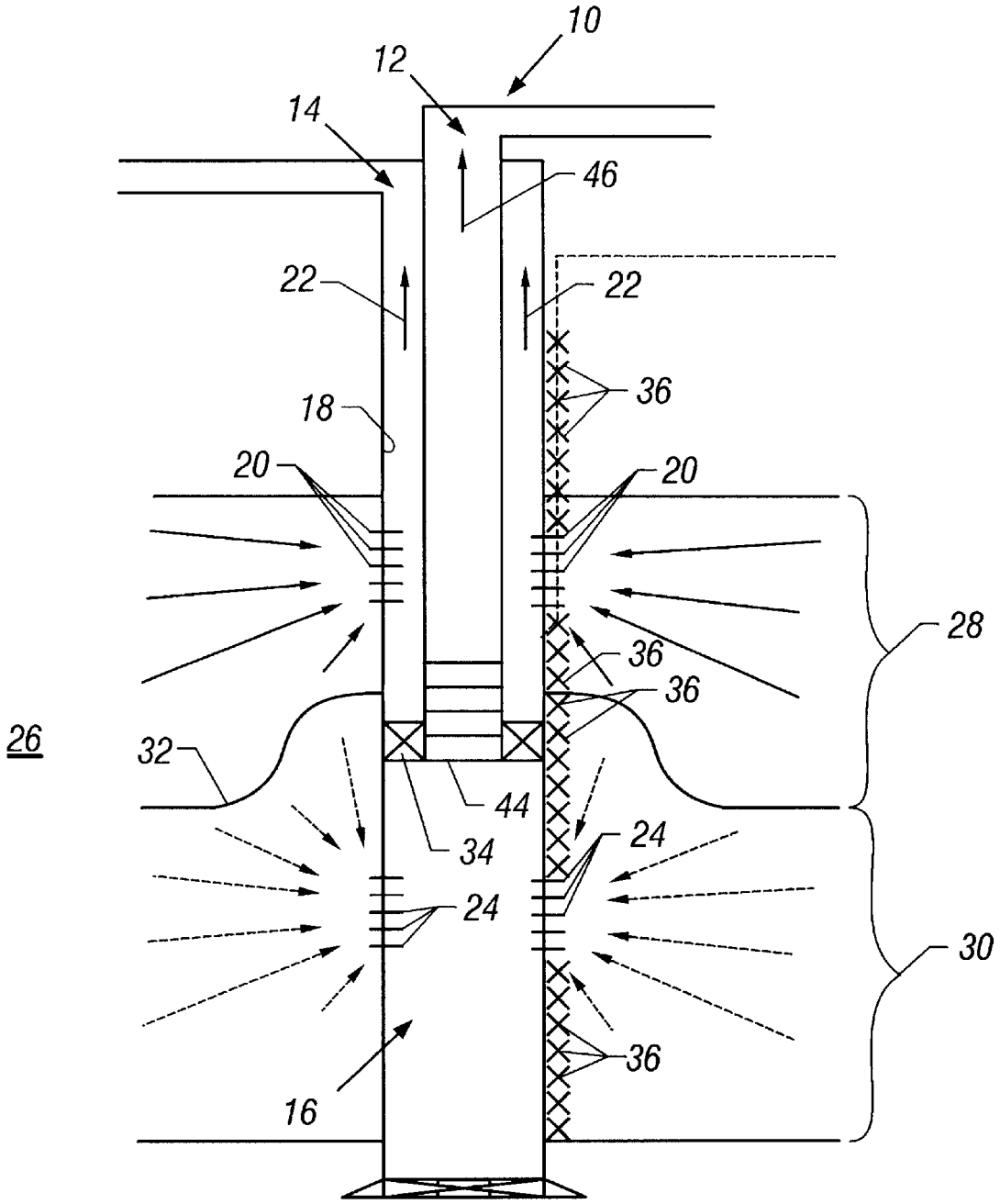
FIG. 2 is a front elevational view of an alternate dual completion production system similar to FIG. 1.

In FIG. 1, a representative system for producing oil and water is illustrated, but a variety of systems may be utilized. For example, rather than control valves, an electric submersible pumping (ESP) system 44 may be utilized, as illustrated in FIG. 2. In this embodiment, an ESP system pumps or produces water along a water flow path 46. Receiving/control station 38 is utilized in selecting the appropriate operating speed of electric submersible pumping system 44 to control the flow of water based on the output from sensors 36. Depending on the type of formation and the natural pressure acting on oil zone 28, the production of oil along oil flow path 22 may be controlled by, for example, a control valve or another electric submersible pumping system. Electric submersible pumping systems are used, for instance, when the natural well pressure is not sufficient to raise the liquid to the surface of the earth.

Figure 3:
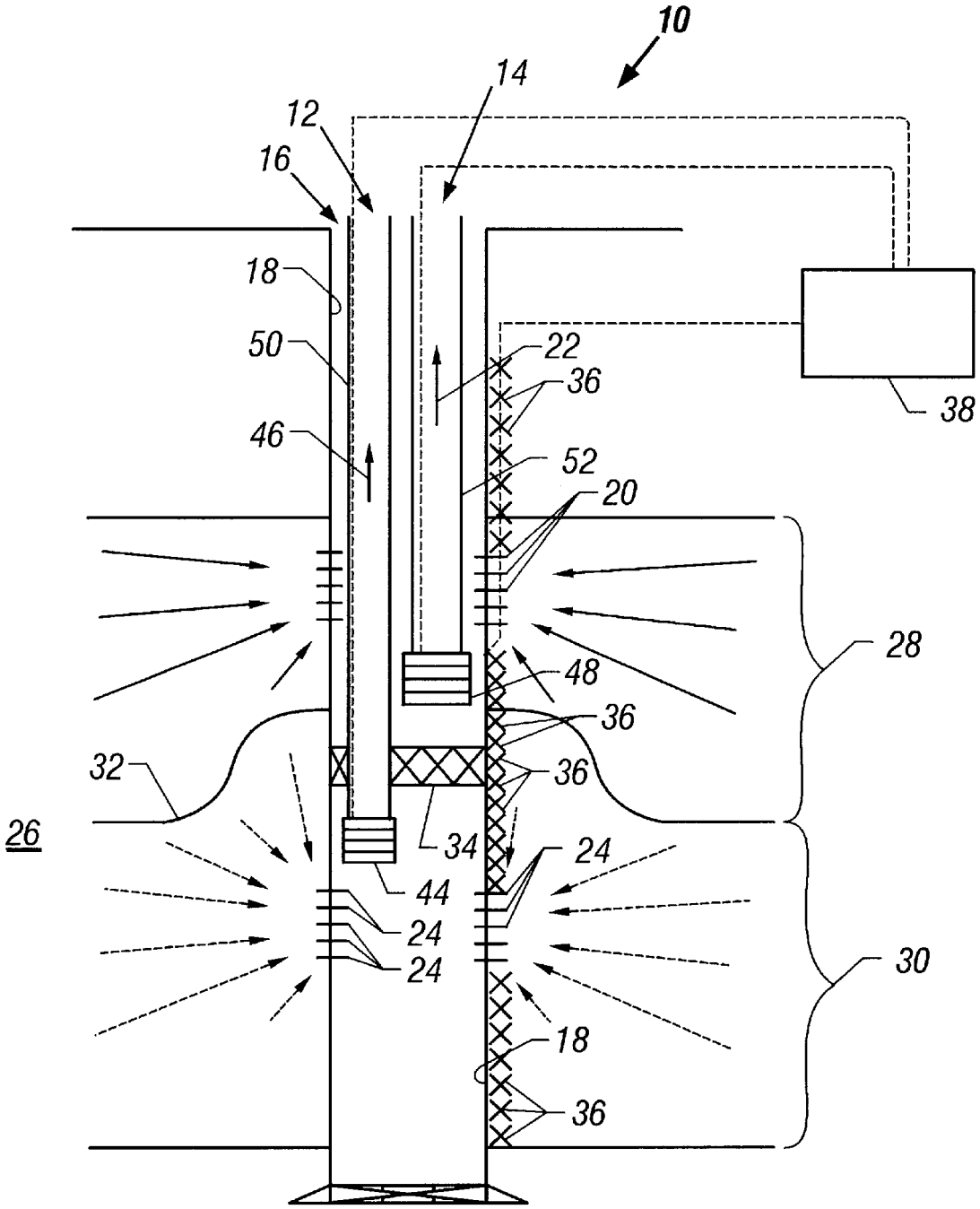
FIG. 3 is another alternate embodiment of the dual completion production system illustrated in FIG. 1.

One example of a dual completion having dual electric submersible pumping systems is illustrated in FIG. 3. In this embodiment, water is produced along water flow path 46 by electric submersible pumping system 44, and oil is produced along oil flow path 22 by a second electric submersible pumping system 48. By way of example, water may be produced through a tubing string 50, and oil may be produced through a second tubing string 52. The pump speed of either or both electric submersible pumping systems 44 and 48 may be adjusted to control one or both of the oil and water production rates and consequently the oil-water interface proximate wellbore casing 18.

Figure 4:
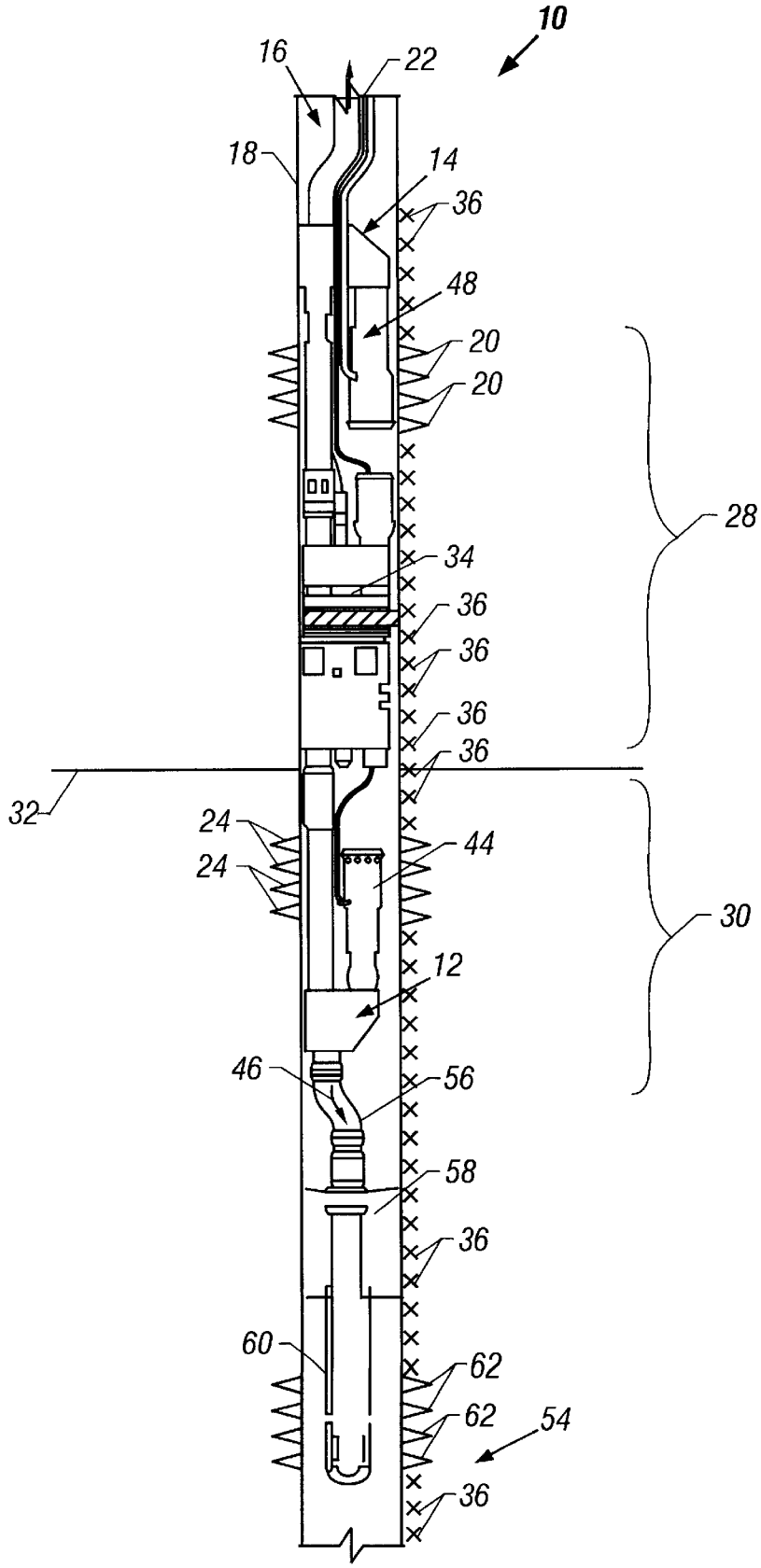
FIG. 4 is an alternate embodiment of an oil and water production system in which the water is reinjected at a separate subterranean location.

Alternatively, water may be produced to a subterranean location 54, as illustrated in FIG. 4. In this exemplary embodiment, electric submersible pumping system 44 directs the water downwardly along water flow path 46 through a tubing 56. Tubing 56 extends through a lower packer 58 that separates the water intake portion of wellbore 16 from the water injection portion of wellbore 16. As illustrated, water is discharged beneath lower packer 58 into wellbore 16 through a discharge end 60. The water is then forced or injected into formation 26 through a plurality of perforations 62. Again, the production rates of oil and/or water can be controlled based on data received from sensors 36, e.g. electrodes disposed along the exterior of the wellbore casing above, between and below perforations 20, 24 and 62. Thus, a variety of oil and water production systems can be utilized in controlling oil-water interface 32.

The data output from sensors 36 can be utilized in a variety of ways to observe and control the oil-water interface 32. Accordingly, the model based control and observation based control methods discussed herein are merely exemplary utilizations of the data provided. For purposes of this discussion, it may be assumed that sensors 36 comprise an electrode array disposed on the outside of wellbore casing 18.

In the model based control example, geological formation 26 is initialized with available knowledge, such as seismics, the known geology and wellbore logs. Properties, such as permeabilities, capillary pressures and relative permeabilities are estimated, often based on core data obtained for the specific geological formation, as known to those of ordinary skill in the art.

Figure 5:
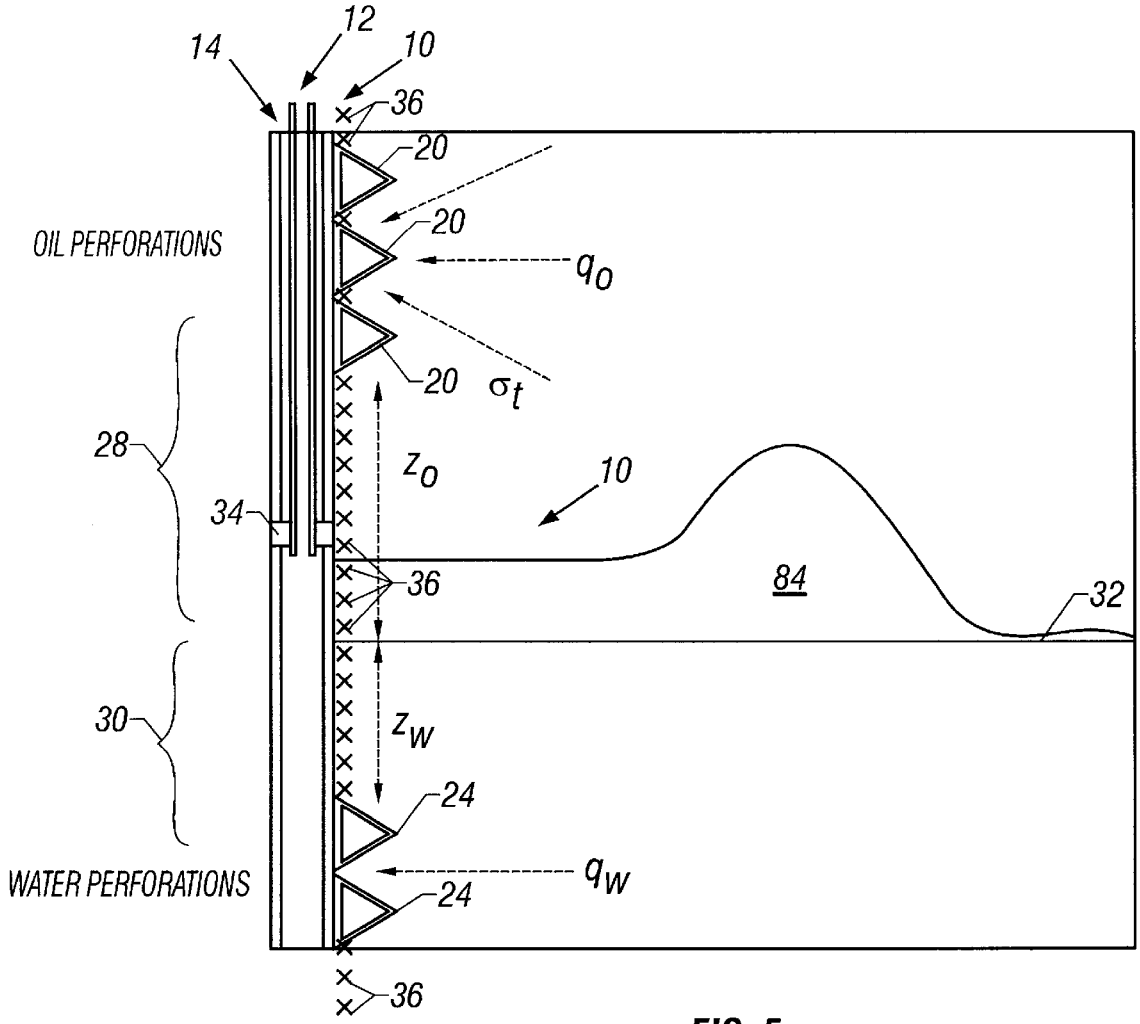
FIG. 5 is a front elevational view of a system for producing liquids from two separate production zones.

Based on this available knowledge, a reservoir simulation program (e.g. ECLIPSE™, available from Geoquest) is run to determine optimal completion distances $z_o$ and $z_w$, as illustrated in FIG. 5. The distance $z_o$ represents the distance between oil perforations 20 and the original oil-water interface 32. Similarly, the distance $z_w$ represents the desired distance between water perforations 24 and the oil-water interface 32. Based on formation properties, the estimated flow rates of water ($q_w$) and oil ($q_o$) out of formation 26 also are estimated. When water completion 12 and oil completion 14 are operated to achieve the estimated flow rates, a full flow simulation may be carried out based on the flow rates and the formation properties. For example, saturation and concentration data may be used to estimate current/voltages at the various electrode sensor locations. Typically, the saturation and concentration data is converted into conductivity values through suitable petrophysical transformations to facilitate comparison of the estimated current/voltages at the sensor locations with the actual data provided by sensors 36. All of the accumulated data at various time points may be compared with the actual measured values from sensors 36 to update parameters of the model and predict optimal production values on an iterative basis, e.g. according to the least squares method.

Figure 6:
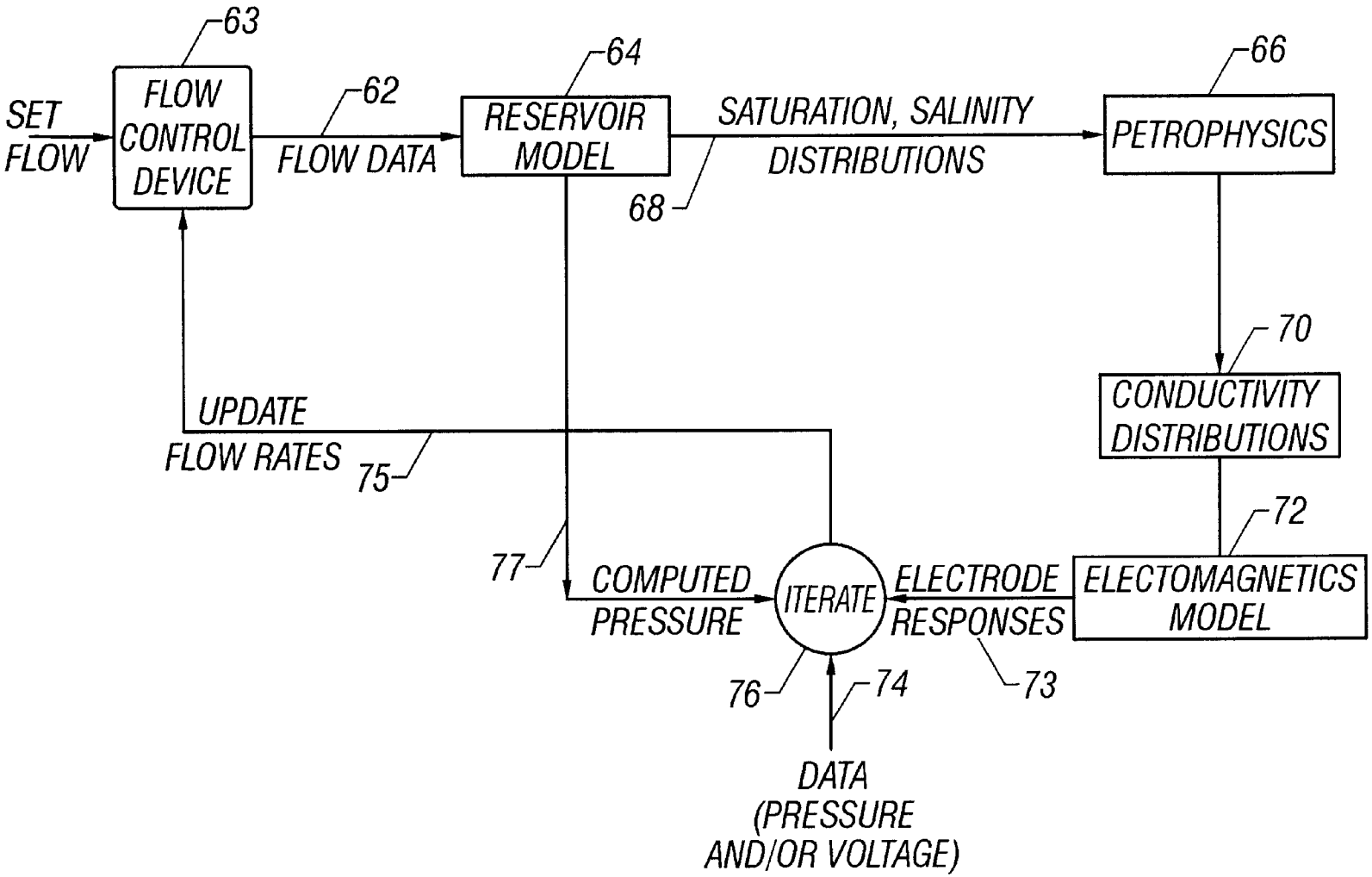
FIG. 6 is a flow chart illustrating an exemplary methodology for utilizing data from sensors disposed through the interface between the produced fluids.

The general reservoir model approach is illustrated best in FIG. 6. As discussed above, flow and formation data 62 from a flow control device 63, e.g. a pump or valve, are utilized in creating a model of the reservoir 64. From this reservoir model, petrophysics (block 66) can be utilized to convert saturation and salinity distribution data 68 into estimated conductivity distributions 70 across electrode array 36. The conductivity distributions are applied to an electromagnetics model 72, and compared with actual output from electrodes 36. The actual electrode responses 73 are used with other data 74, e.g. pressure and voltage data, to initialize and update flow rates (see reference numeral 75) and, consequently, the flow data 62 used by reservoir model 64. Typically, the electrode responses 73, data 74, and computed data 77, e.g. computed pressures, are compared and used to update flow rates on an iterative basis (see block 76). Based on the continuously updated reservoir model, the production rates of oil ($q_o$) and/or water ($q_w$) are adjusted to maintain a desired oil-water interface at a location that mitigates or reduces water coning. As recognized by those of ordinary skill in the art, the actual reservoir model and the data utilized in constructing and updating the model may vary between reservoirs and applications.

Alternatively, an observation based control methodology may be used to limit oil and water incursion into the water and oil completions, respectively. Control of the oil and/or water production can be accomplished based either directly on the sensor voltages/currents or through the estimated interface location. Production control, based directly on the sensor voltages/currents, relies on the difference between measured sensor values and the desired sensor values determined from knowledge of the sensor physics and output relative to surrounding environment. If, on the other hand, the control is based on estimated interface location, a control algorithm is utilized to maintain the oil-water interface 32 at a specific location to limit mingling of fluids in the production stream. By way of example, oil-water interface 32 is observed either directly or through inference based on computations as discussed herein.

Figure 7:
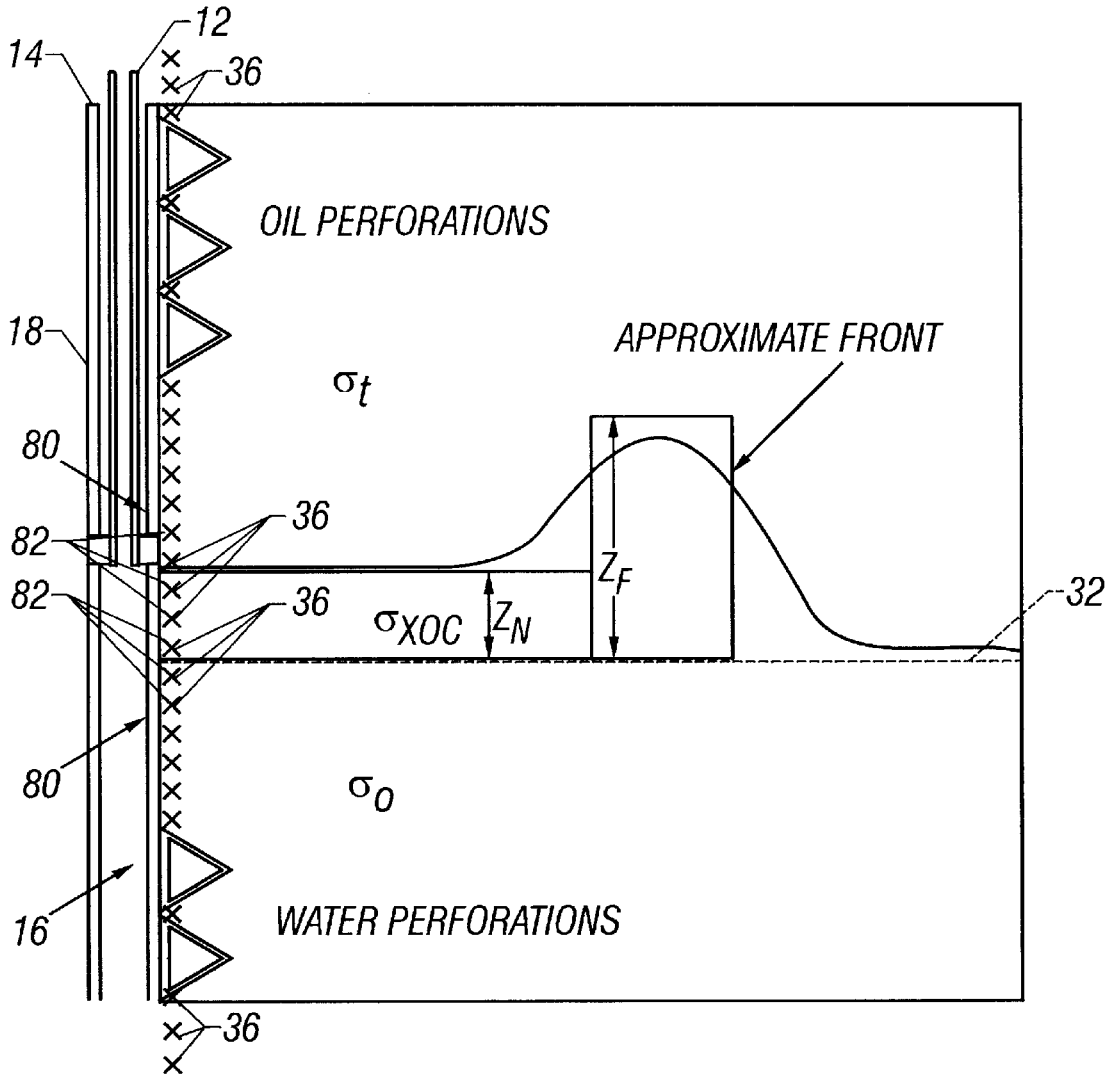
FIG. 7 is an illustration similar to FIG. 5 showing additional parameters of an interface formed between the produced liquids.

In an exemplary application, a control algorithm is used to drive the oil-water interface 32 to a desired interface location. In this example, it can be assumed that the reservoir in the region of interest is homogeneous. Also, the array of electrodes 36 is disposed on the outside of wellbore casing 18, as illustrated in FIG. 7. Exemplary sensors 36 include one (or two) current providing (return) electrodes (80). These current electrode(s) are rotated among sensors 36 so that the remainder of the sensors function as voltage electrodes. When one current electrode operates as an injector, the return is at infinity, and the other electrodes function as voltage measuring electrodes. By definition, the voltage electrodes draw negligible current. In another mode, voltages can be maintained at the electrodes, and measured currents can be injected.

Any substantial change in formation resistivity between the voltage electrodes 82 is easily detected, because the leakage current from the wellbore to the formation changes. Because the formation current is proportional to the gradient in the potential along the wellbore, any change in the formation current is reflected in terms of a jump in the derivative of electrical potentials along the wellbore. The electrodes that straddle this particular region are sufficient to indicate the region of saturation change and a marker for this region may be established. In a situation where the electrodes are kept at a constant potential (and current injected is measured instead), a jump in the current injected is the position of the region of saturation change at the wellbore. Thus, in this situation, it is straightforward to detect the nominal position of the water encroachment based on the voltage or current measurements of electrodes at the region of saturation change. Accordingly, the production rate of oil and/or water can be adjusted to maintain the oil-water interface 32 at a desired location.

However, in some environments, a hump or an anomalous rise of oil-water contact 84 develops in addition to the oil-water interface surrounding wellbore casing 18, as illustrated in FIG. 7. The hump may develop away from the wellbore at distances comparable to the thickness of the formation being produced. Computations have shown that for a fixed ratio of oil to water production, the rise-height of the hump 84 is governed predominantly by the oil production rate. Thus, in such environments, increasing the oil rate increases the water hump which, upon reaching a certain size, can lead to breakdown of the dual production system.

It has been determined that the production rates can be controlled not only for the oil-water contact close to the wellbore but also for control of hump 84. If a hump is formed by the advancing water, the rise height of the hump may be an important factor in observation based control. However, the height of the distant hump 84 can be obtained through data provided by sensors 36. (See FIGS. 8A and 8B).

In this particular example, we can assume that the height of the water-oil contact close to the wellbore is equal to $Z_n$ and that the height of the hump 84 is $z_f$. Based on prior simulations, the desired position of $z_n$ and $z_f$, i.e., the set points, can be labeled as $z_{sn}$ and $z_{sf}$, respectively. The errors in the near and far rise are established by the equations $$\epsilon_n = Z_n - Z_{sn},$$

and $$\epsilon_f = Z_f - Z_{sf}.$$

If submersible pumps are used for the production of water and oil as with the electric submersible pumping systems 44 and 48 of FIG. 3, the pumps may be operated to produce a flow rate on the basis of $$\frac{d\frac{q_w}{q_o}}{dt} = k_{bb}\epsilon_n + k_{bt}\epsilon_f$$

where the $k_{bt}$ term is expected to be small compared to the first.

The oil rate is controlled by $$\frac{dq_o}{dt} = k_{tt}\epsilon_f + k_{tb}\epsilon_n$$

where the $k_{tb}$ term is again expected to be small. All of the k terms are control constants that will vary depending on the application and formation but are best obtained by direct flow and electromagnetics simulation of the reservoir. The k values do not need to be optimized strictly but rather k values can be selected that appear to produce a reasonable response. An alternative to the above equations for controlling the ratio of water to oil rates, involves directly choosing to control water rates based on the errors $\epsilon$. Also, depending the formation characteristics and the devices used for producing water and oil (e.g. control valves), additional or different terms may be required to better approximate the flow rates required to adequately control the oil-water interface.

Figure 8A:
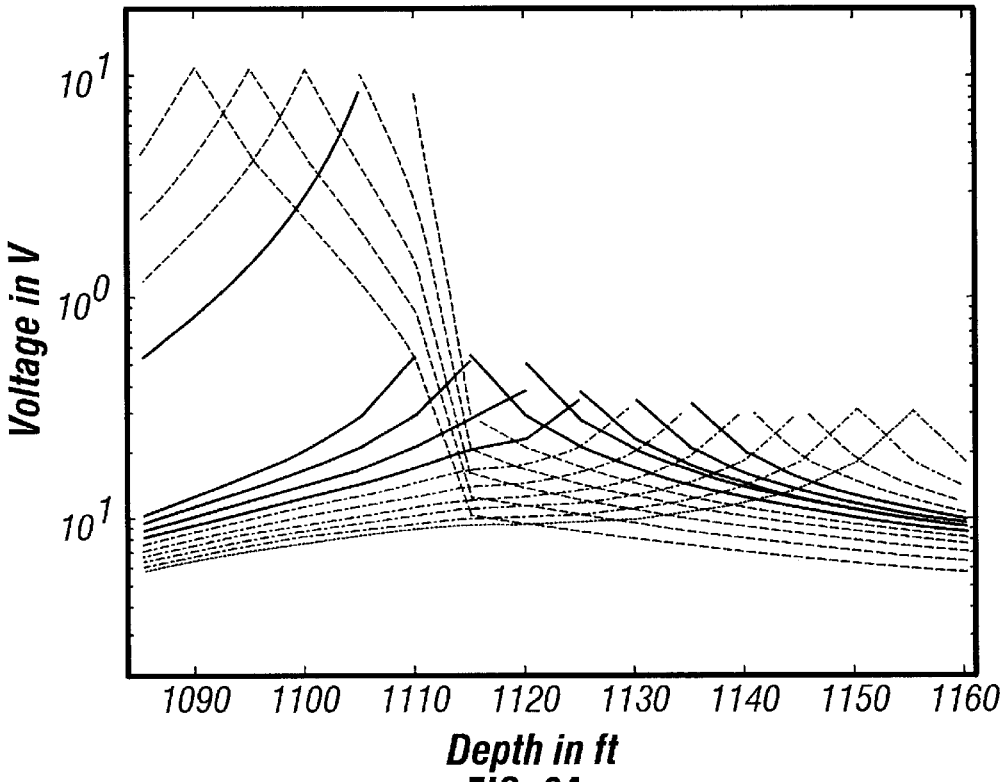
FIG. 8A is a graphical representation of changes in the sensor output relative to changes in the oil-water interface.
Figure 8B:
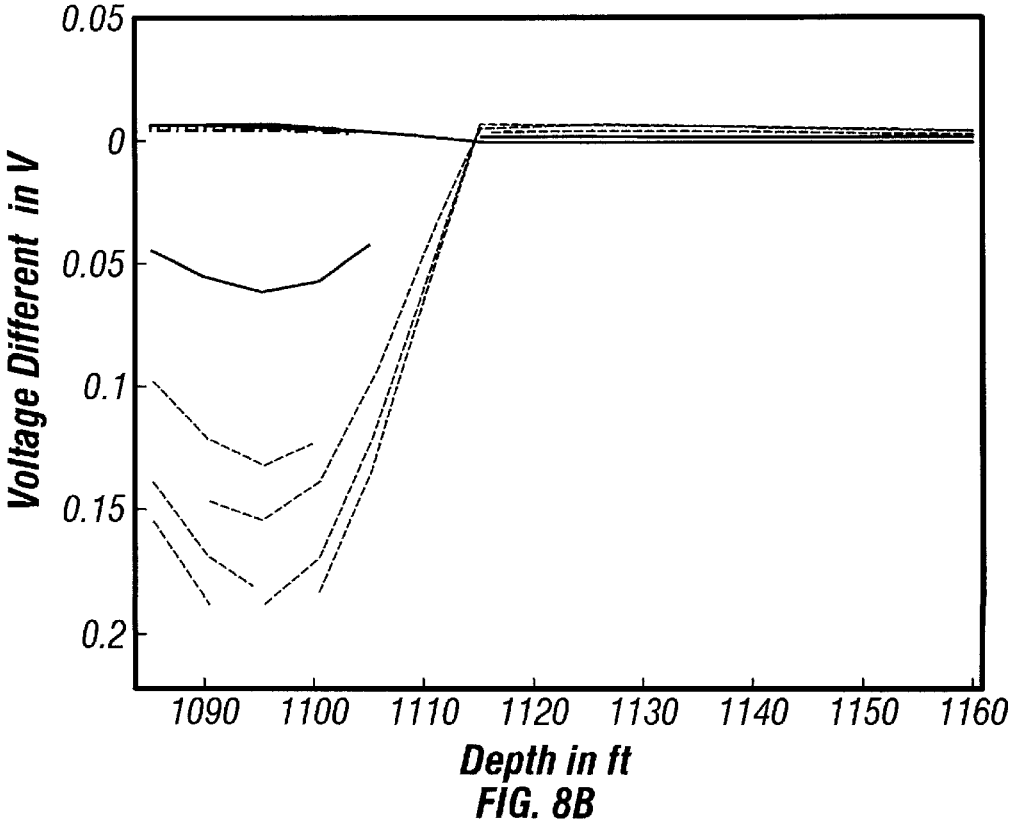
FIG. 8B is another graphical representation of changes in the oil-water interface relative to changes in sensor output.

Referring to FIGS. 8A and 8B, examples of actual electrode array responses are provided that reflect water rise height near the wellbore ($Z_n$) and rise height of the hump 84 ($Z_f$). In this example, the original oil-water interface was at approximately 1,120 feet and has moved up to 1,115 feet at the wellbore during production. This change, $Z_n$ is seen as a discontinuity in the derivative of voltages output by electrodes 82. The computation of $Z_n$ is straightforward based on the output from sensors 36, as best illustrated in FIG. 8A.

In this same example, the movement of the hump is detected (and therefore inverted) from the electrode array data, as illustrated in FIG. 8B. In this sample, the difference in the computed response based on output from sensors 36 provides an estimated hump height change of 5 feet.

However, it should be noted that the discussion above is merely of exemplary uses of the data provided by sensor array 36. The actual calculation of a hump height may or may not be necessary, depending on the particular formation and the production rates. Additionally, the production equipment, conductivity of the liquids being produced, formation characteristics, type of sensor array 36, etc. all affect the formulas, models or direct usage of the output data. However, the data can readily by adapted to aid in the real time monitoring and control of fluid production for preventing intermingling of liquids due to water coning or oil coning.

It will be understood that the foregoing description is of exemplary embodiments of this invention, and that the invention is not limited to the specific forms shown. For example, variety of sensors may be utilized, e.g. a distribution of pressure sensors or acoustic sensors. Similar to segregated oil/water production, it is to be understood that a gas/oil interface may be detected (by, for example, acoustic sensors) and controlled by adjusting gas and oil rates similar to adjustment of the oil and water rates based on the equations given above for the oil/water system. Also, the procedure described above can be further extended to include segregated three phase production of gas, oil and water. Furthermore, different types of completions and arrangements of completions can be utilized to remove oil and water from the formation; and the models or algorithms used in estimating any changes in liquid production rates may be adjusted according to the environment and specific application. These and other modifications may be made in the design and arrangement of the elements without departing from the scope of the invention as expressed in the appended claims.

What is claimed is:

1. A method for reducing watercut during the production of a desired production fluid from a well having a wellbore lined by a wellbore casing, comprising:

perforating the wellbore casing proximate a production fluid zone and a water zone to permit ingress of a production fluid and water into the wellbore;

producing the production fluid from the production fluid zone;

removing the water from the water zone to reduce watercut into the production fluid zone;

sensing the location of an interface between the production fluid and the water via a sensor array deployed external to the wellbore casing; and adjusting the rate at which at least one of the production fluid and the water moves into the wellbore based at least in part on the location of the interface.

2. The method as recited in claim 1, wherein producing comprises producing a petroleum product.

3. The method as recited in claim 2, wherein sensing comprises utilizing an electrode sensor array.

4. The method as recited in claim 3, further comprising obtaining a plurality of output values from the electrode sensor array and utilizing those values in a reservoir model to determine whether a change in the flow rate of the petroleum product or the water is desired.

5. The method as recited in claim 3, wherein adjusting is based directly on a plurality of output values from the electrode sensor array.

6. The method as recited in claim 3, wherein producing the petroleum product comprises producing the petroleum product through a completion.

7. The method as recited in claim 6, wherein removing the water comprises removing the water via a second completion.

8. The method as recited in claim 7, wherein the completion comprises an electric submersible pumping system.

9. The method as recited in claim 8, wherein the second completion comprises a second electric submersible pumping system.

10. The method as recited in claim 7, wherein removing comprises removing the water to a location at the surface of the earth.

11. The method as recited in claim 7, wherein removing comprises reinjecting the water at a subterranean location.

12. The method as recited in claim 7, wherein the completion comprises a control valve.

13. The method as recited in claim 12, wherein the second completion comprises a second control valve.

14. The method as recited in claim 3, wherein utilizing includes deploying at least one electrode of the electrode sensor array as a current emitter.

15. A method for determining and controlling the location of a fluid-fluid interface along a wellbore used in the production of oil, comprising:

deploying a plurality of sensors along an exterior of the wellbore above and below the fluid-fluid interface; and outputting a signal from each sensor to indicate the presence of a first fluid or a second fluid.

16. The method as recited in claim 15, wherein outputting comprises outputting a signal indicative of oil as the first fluid.

17. The method as recited in claim 16, wherein outputting comprises outputting a signal indicative of water as the second fluid.

18. The method as recited in claim 17, further comprising:

adjusting at least one of an oil production rate and a water production rate based on the signals output from the plurality of sensors.

19. The method as recited in claim 18, wherein deploying comprises deploying an electrode array having a plurality of electrodes able to output a voltage signal indicative of the presence of oil or water.

20. The method as recited in claim 19, wherein deploying comprises deploying at least one electrode that is a current emitter.

21. The method as recited in claim 19, wherein deploying comprises locating the plurality of electrodes external to a wellbore casing lining the wellbore.

22. The method as recited in claim 21, further comprising determining the height of a hump in the oil-water interface remote from the wellbore.

23. The method as recited in claim 19, wherein adjusting comprises pumping the oil via an electric submersible pumping system.

24. The method as recited in claim 23, wherein adjusting comprises pumping the water via a second electric submersible pumping system.

25. The method as recited in claim 24, wherein pumping the water includes directing the water to a subterranean injection location.

26. The method as recited in claim 15, wherein outputting comprises outputting a signal indicative of a gas as the first fluid.

27. A system for controlling an oil-water interface disposed about a wellbore utilized in the production of an oil, comprising:

a first completion disposed within the wellbore for producing oil;

a second completion disposed within the wellbore for producing water; and a sensor array disposed along the wellbore across an oil-water interface formed between the oil and the water, wherein at least one of the first and the second completions may be controlled to adjust the location of the oil-water interface based on output from the sensor array.

28. The system as recited in claim 27, wherein the sensor array comprises a plurality of electrodes able to output signals that may be used to determine the presence of an oil or a water.

29. The system as recited in claim 28, wherein the sensor array comprises at least one electrode that is a current emitter.

30. The system as recited in claim 28, wherein the wellbore is lined by a wellbore casing and the plurality of electrodes are positioned outside the wellbore casing.

31. The system as recited in claim 28, wherein the first completion comprises a control valve.

32. The system as recited in claim 28, wherein the first completion comprises an electric submersible pumping system.

33. The system as recited in claim 28, wherein the second completion comprises a control valve.

34. The system as recited in claim 28, wherein the second completion comprises an electric submersible pumping system.

* * * * *